United States Patent [19]

Glockenstein

[11] Patent Number: 4,662,131

[45] Date of Patent: May 5, 1987

[54] WALL ELEMENT

[76] Inventor: Karl Glockenstein, Mautner Markhofgasse 94, 1110 Wien, Austria

[21] Appl. No.: 577,160

[22] Filed: Feb. 6, 1984

Related U.S. Application Data

[62] Division of Ser. No. 364,252, Apr. 1, 1982, Pat. No. 4,603,530.

[51] Int. Cl.[4] ..... E04B 2/82

[52] U.S. Cl. ..... 52/126.4; 52/238.1

[58] Field of Search ..... 52/126.2, 126.3, 126.4, 52/126.6, 208, 210, 239, 264, 265, 404, 658, 741, 782, 290, 455–458, 238.1, 241

[56] References Cited

U.S. PATENT DOCUMENTS

| | | | |
|---|---|---|---|
| 1,798,392 | 3/1931 | Adams, Jr. et al. | 52/126.4 |
| 2,001,574 | 5/1935 | Jacobson | 52/126.4 |
| 2,094,265 | 9/1937 | Curren | 52/264 |
| 2,332,732 | 10/1943 | Laucks | 52/210 |
| 2,380,692 | 7/1945 | Gunnison | 52/126.6 |
| 2,443,548 | 6/1948 | Wilson | 52/126.3 |
| 2,770,334 | 11/1956 | Rust et al. | 52/656 |
| 2,814,078 | 11/1957 | Durr | 52/566 |
| 2,969,565 | 1/1961 | Levy | 52/239 |
| 3,008,550 | 11/1961 | Miles et al. | 52/210 |
| 3,133,322 | 5/1964 | Douglas | 52/265 |
| 3,400,504 | 9/1968 | Neisewander | 52/126.3 |
| 3,411,252 | 11/1968 | Boyle, Jr. | 52/126.4 |
| 3,570,200 | 3/1971 | Ritner | 52/126.4 |
| 3,638,376 | 2/1976 | Howes et al. | 52/109 |
| 3,845,601 | 11/1974 | Kostecky | 52/241 |
| 3,999,353 | 12/1976 | Dielman | 52/731 |
| 4,034,524 | 7/1977 | Fromme et al. | 52/143 |
| 4,125,972 | 11/1978 | Pate | 52/282 |
| 4,193,233 | 3/1980 | Vanden Hoek et al. | 52/126.4 |
| 4,391,073 | 7/1983 | Mollenkopf et al. | 52/241 |

FOREIGN PATENT DOCUMENTS

| | | | |
|---|---|---|---|
| 402633 | 2/1965 | Australia | 52/126.6 |
| 1196345 | 7/1965 | Fed. Rep. of Germany | 52/126.6 |
| 2130929 | 6/1973 | Fed. Rep. of Germany | 52/126.4 |
| 2328179 | 12/1974 | Fed. Rep. of Germany | 52/126.6 |
| 2626153 | 12/1977 | Fed. Rep. of Germany | 52/290 |
| 1454115 | 9/1966 | France | 52/126.6 |
| 285045 | 12/1952 | Switzerland | 52/238.1 |

*Primary Examiner*—John E. Murtagh
*Assistant Examiner*—Andrew Joseph Rudy
*Attorney, Agent, or Firm*—Frost & Jacobs

[57] ABSTRACT

Wall element, in particular for the interior walling of buildings, comprising an, optionally stressed, frame structure on both sides of which a cover plate having sufficient inherent stiffness is attached, which structure is preferably provided with a filling of thermic and/or sound insulating material, at least a portion of the frame being offset, or capable of being offset, rearward in relation to at least one edge of at least one of the cover plates.

3 Claims, 18 Drawing Figures

Fig. 6
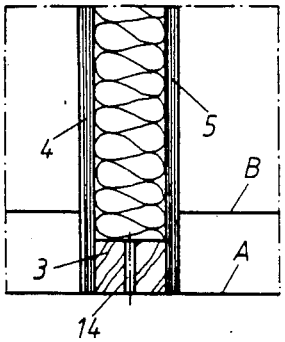
Fig. 7
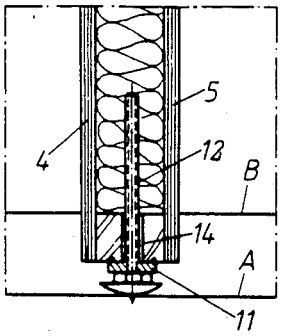
Fig. 8
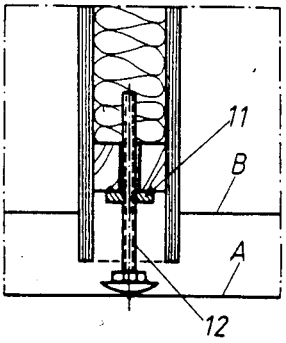
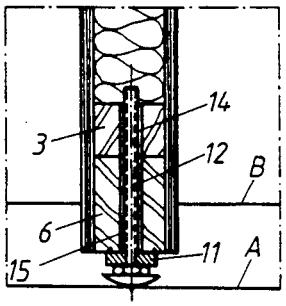
Fig. 9
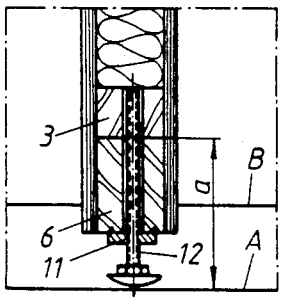
Fig. 10
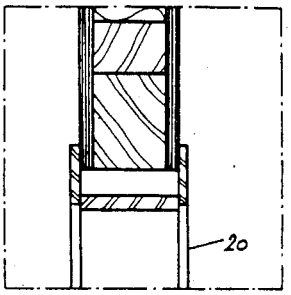
Fig. 11
Fig. 12
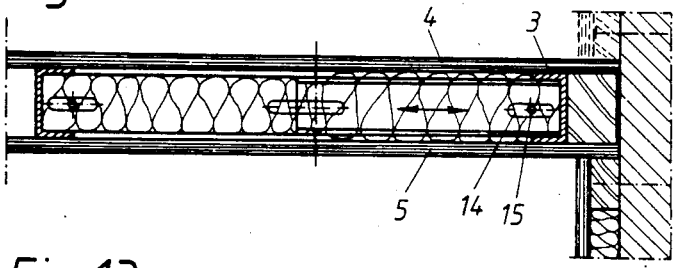
Fig. 13
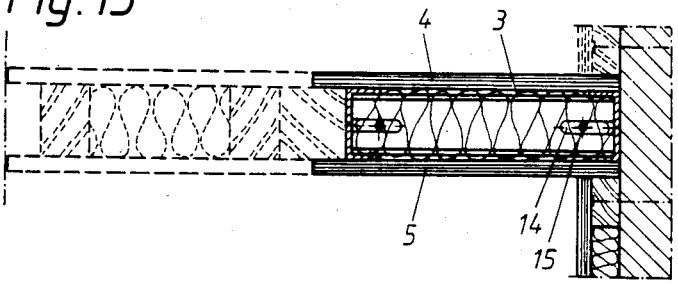
Fig. 16
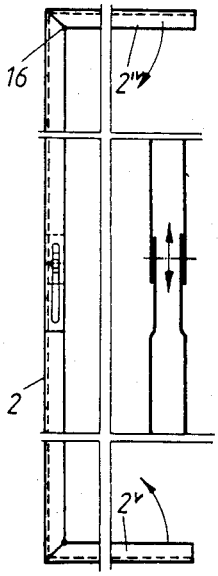

WALL ELEMENT

This is a division of application Ser. No. 364,252 filed Apr. 1, 1982, now U.S. Pat. No. 4,603,530.

The invention relates to a wall element, in particular for the interior walling of buildings, consisting of an optionally stressed frame structure on both sides of which a cover plate having sufficient inherent stiffness is attached, which structure is further preferably provided with a filling of thermic and/or sound insulating material.

It is the object of the invention to provide wall elements which are prefabricated and offer a possibility of adaptation to the space dimensions up to a predetermined order of magnitude without assembly at the building site. The main aim is the dry erection of partitions in the interior walling of buildings at a minimum of technical knowledge ("Do-it-Yourself-Method") and minimum requirements of tools. Moreover, the facings are to be eliminated so as to encounter no obstacles in the interior finishing work.

This object is achieved according to the invention in a wall element of the type initially mentioned by providing for at least a portion of the frame to be offset, or capable of being offset, rearward in relation to at least one edge of at least one of the cover plates.

This embodiment permits a precise adaptation to the actual dimensions within the building by cutting off the excess portions of the cover plates from the prefabricated element. A further advantage of the object of the invention resides in the fact that due to the appropriate dimensioning of the maximum cutoff area, conveyor line production is possible, since the wall elements can now be produced in just one size corresponding to this cutoff measure, so that the accompanying advantages over single-part production of small series production conventional up to now can be achieved and stock-keeping becomes possible, with the result that wall elements of this type may be offered by any building material merchant like any other building material.

The invention is described in the following under reference to embodiments shown in the drawings.

FIGS. 6 to 10 are views of the lower rim of the wall element at various room heights;

FIG. 11 shows the adjustment of the wall element to door and/or window openings;

FIG. 12 shows a horizontal section through another embodiment of a wall element according to the invention;

FIG. 13 shows the section according to FIG. 12, but at changed room height;

FIG. 16 is a view of frame parts having pivotable legs;

Figure 1:
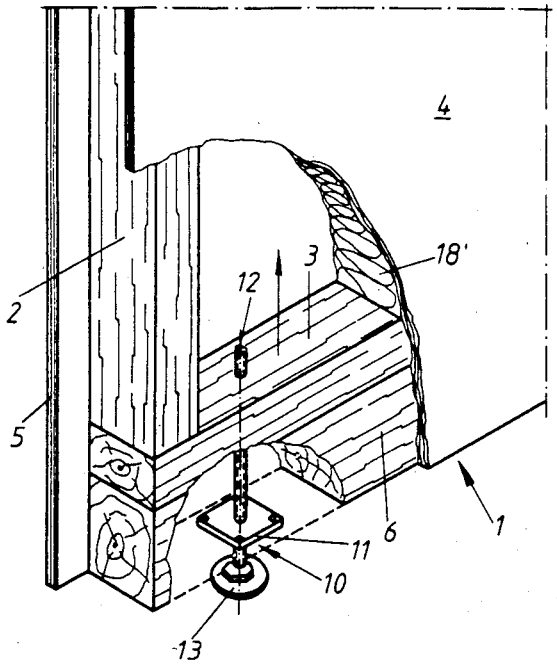
FIGS. 1 and 2 are partial views of embodiments of a wall element according to the invention partially cut.
Figure 2:
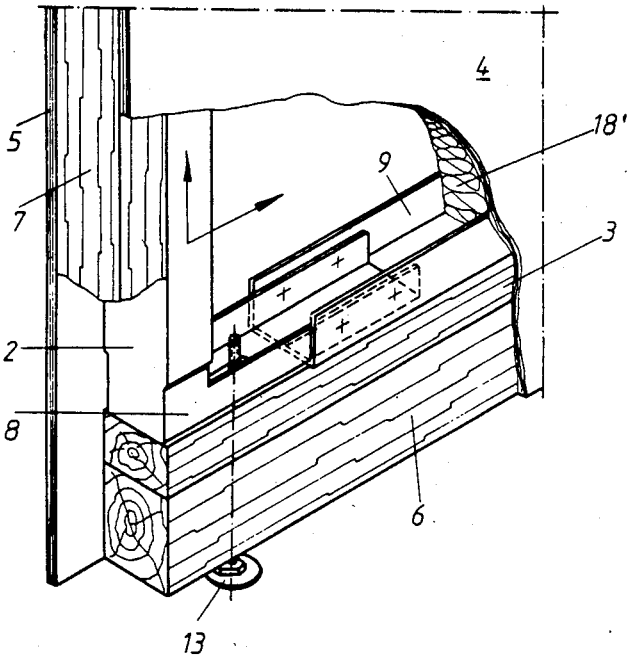

According to FIGS. 1 and 2, the wall element generally bearing the reference number 1 consists of a wooden supporting frame having edge uprights 2 and crossbars 3. The figures each show only a cutaway portion with one upright 2 and the lower crossbar 3. On these frames composed of the uprights and crossbars, cover plates 4 and 5, for instance plasterboard plates having adequate inherent stiffness are attached on both sides in a suitable manner, such as by means of screws, nails, adhesive or the like. In the embodiment shown in FIGS. 1 and 2, cutting off in height is made possible by arranging the lower crossbar 3 offset backwards in relation to the edge of the plates 4 and 5 by a maximum cutting extent into the interior of the element 1. The cavity thus formed in the edge zone of the element 1 is filled up by a squared timber 6 which is only slid into the element 1 or fixed thereto in an easily releasable manner. In this zone, the two cover plates 4 and 5 are attached only to the crossbar 3. It is thus easily possible to adjust the height of the element to the dimensions of the room in which it is to be installed by cutting the element 1 on its lower rim without impairing its properties as a stressed structure. In addition, the element 1 may be provided with leveling supports 10 so as to compensate for any unevenness of the floor. In the embodiment shown, the leveling supports 10 consist of a plate 11 releasably attached to, in particular slipped onto, a crossbar 3, the plate 11 being provided with a threaded hole into which an adjusting screw 12 with supporting head 13 is screwed. The crossbar 3 and the squared timber 6 arranged underneath it are provided with corresponding bores for receiving the adjusting screw 12.

FIG. 2 shows two further possibilities, in addition to those described in connection with the height adjustment by means of the squared timber 6 in FIG. 1, for an adjustment in width of the element. The possibility of adjustment or cutting off in width can be provided in the same manner as for the adjustment in height, by offsetting the upright 2 rearward into the interior of the element 1 from its rim and mounting a packing block 7 similar to the squared timber 6.

The second possibility for cutting off consists in the upright 2 being attached to crossbars 3 adjustably on its two ends. For this purpose, for instance, a U-shaped rail element 8 protruding transversally from the upright 2 and resting on the crossbar 3 could be attached to the front face of the upright 2. For connection with the crossbar, the embodiment shown is provided on the crossbar with a U-shaped profile 9 enclosing the U-rail 8 slidably therein. The connection between the two U-shaped parts 8 and 9 can be effected in the spots indicated by means of dots by means of self-tapping screws or the like piercing the plates 4, 5.

The wall element shown in FIGS. 1 and 2 is provided with a filling 18' or thermic or sound insulating material which also possesses flame-retarding properties, such as, for instance, mineral wool. The filling 18' is compressible and can be cut along its edges for adjustment of the wall element.

Figure 3:
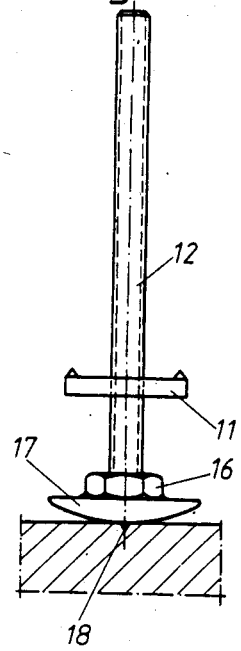
FIG. 3 is a view of the adjusting screw and nut for height adjustment of the wall element in enlarged scale.
Figure 4:
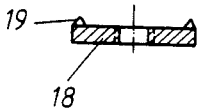
FIG. 4 is a sectional view through the nut of FIG. 3.
Figure 5:
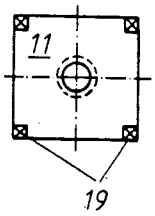
FIG. 5 is a plan view of the nut of FIG. 3.

In FIGS. 3 to 5, the adjusting screw 12 and the nut 11 are shown in detail in enlarged scale. The adjusting screw 12 has a hexagonal head with collar 16 on which a wrench can be placed for adjustment of the screw in the threaded bore of the nut 11. The head part 17 of the adjusting screw 12 is provided with a centering projection 18 extending coaxially in relation to the axis of the screw and insertable into the floor. The nut 11 has the shape of a rectangular plate which is provided in each of its corner zones with a prong-like projection 19 for the selective attachment of the nut 11 onto the frame 2, 3 or the leveling part 6.

FIGS. 6 to 11 show the extent of the adjustability of the element 1 to the premises.

In the position shown in FIG. 6, the minimum position, the building element 1 is cut off to its maximum cutting extent, namely, down to the bottom edge of the crossbar 3, with the height adjustment 10 not yet in action and the crossbar 33 immediately abutting the subfloor level A. The floor level bears the reference symbol B.

FIG. 10 shows the maximum height adjustment of the uncut element in relation to the subfloor level A of the room. The adjusting screw 12 is shown in the farthest possible projecting supporting position, which means that it is screwed out to project by the distance value a in relation to the bottom edge of the element. The gap thus created between the bottom edge of the element and the subfloor level A is covered up by the floor construction applied later on. The floor level bears the reference symbol B. It is evident that no cover strips are required in walling, since the cover plates reach down below this floor level.

FIGS. 7 to 9 show various intermediary positions. According to FIG. 7, the leveling part 6 is not yet put into place, while the adjusting screw is already in place, completely screwed into the wall element. FIG. 8 shows no leveling part in place, but the adjusting screw 12 screwed as far as possible out of the nut 11. According to FIG. 9, the leveling part 6 is now used with the passage bore 15 for the adjusting screw 12 which is screwed as far as possible into the wall element.

FIG. 11 shows the adaptation of the wall element to door or window openings 20.

Figure 14:
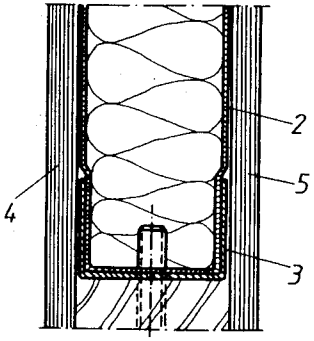
FIG. 14 is a sectional view of the interlocking frame parts.

In FIGS. 12, 13, the frame parts 2, 3 are shown as U-shaped profiles of metal or plastic material and mutually displaceable. The displaceability is assured by one of the U-shaped profiles having a reduced dimension in its one end portion (FIG. 14). For passing the adjusting screw 12 through the frame parts 2, 3, one of these is provided with an oblong hole 14 pierced by the adjusting screw (FIGS. 12, 13).

Figure 15:
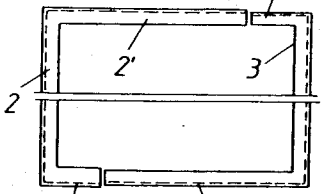
FIG. 15 is a reduced-scale view of an embodiment having frame parts with offset separating line.

The frame parts 2, 3 are mainly of symmetrical shape. For providing an offset separating line, however, it is possible, according to FIG. 15, to provide legs 2', 3' and 2'', 3'' of different lengths of the frame parts 2, 3.

In order to simplify, and save space in, transport and storage, FIG. 16 shows that the legs $2^{IV}$, $2^{V}$ of the frame parts could also be articulated or rotatable. The axis of rotation 16 in this case is provided in the corner zone of the wall element and extends essentially vertically in relation to the plane of the cover plate.

Figure 18:
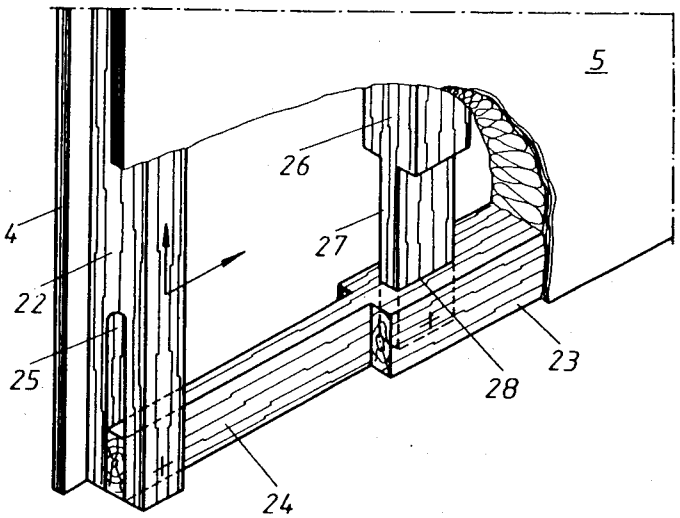
FIG. 18 is a representation according to FIG. 17 at changed room dimension.
Figure 17:
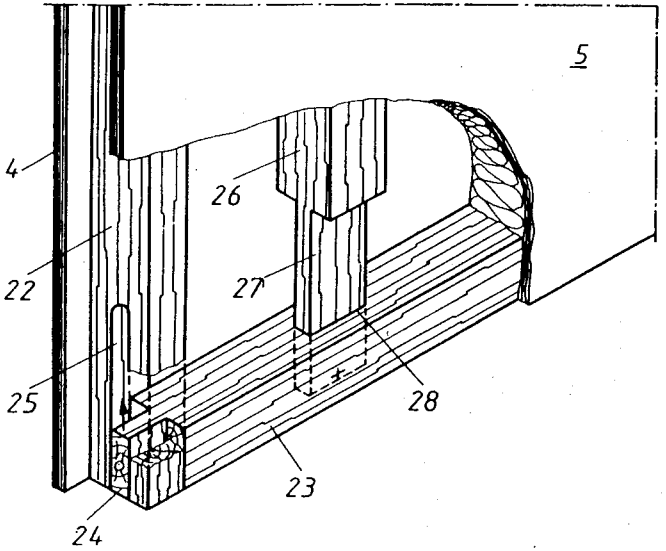
FIG. 17 is a diagrammatic, partially opened view of a wall element according to the invention having frame parts of wood and an intermediary part

In the embodiment according to FIGS. 17 and 18, the frame consists of uprights 22 and crossbars 23. By providing a pin 24 projecting on the front end of the adjustable frame part, i.e. the crossbar 23, and engaging a slot 25 in the adjacent frame part 22, the on frame part (crossbar 23) is adjustable up to the inner end of the slot 25. If the pin 24, as shown in FIG. 17, is longer than the thickness of the frame part (upright 22), an adjustment of the other dimension of the element is possible at the same time.

If additional uprights 26 are provided, they can be fastened on the crossbar 23 by means of a pin-slot-connection, the pin 27 of the additional upright 26 engaging a slot 28 of the crossbar 23 having to be of a length corresponding to the oblong hole on the edge upright 22. The pin 27 is attached to the crossbar 23 after the element has been cut, for instance by means of a fastening screw penetrating from the outside. In the embodiments according to FIGS. 17 and 18, the cover plates 4 and 5 are fixedly connected in prefabrication to the frame parts (uprights 22 and crossbars 23) only in those zones where no adjustment of the frame parts for cutting is provided for.

The frame parts of the element 1 need not consist of wood, but could also be made of metal or plastic material, for instance in the shape of U-profiles, the adjustment of the frame parts in relation to one another made possible by connections of a shape similar to that of the U-rails 8 and 9 shown in FIG. 2.

The embodiment of the building element 1 according to the invention permits a major rationalization in stockkeeping, as all building height and widths can be covered by a minimum number of dimensions. It had proven practical, for instance, to provide height graduations of 15 cm and width graduations of about 30 cm, so that cutting of the individual elements is possible to that extent.

The invention allows an adjustment of the wall elements to the naturally different room heights of 2.45 m to 2.60 m. The invention permits a height adjustment of the element, taking into consideration the removal of the lower threshold, precisely to the millimeter up to 12 cm. For an even greater adjustment in height, 3 more centimeters can be gained by removing the adjusting screw, so that a total height adjustment of 15 cm is possible without impairing the structural and static part of the wall element.

Particular attention is paid to the fact that the wallpaper in building and apartment construction is hung down to the upper edge of the floor and that the required height adjustment of the elements does not necessitate covering up the free spaces thus created by means of facings or other types of covering as in other types of partitioning systems. In the present height adjustment, care was taken of the fact that the minimum floor construction height, including insertion of insulating materials, floors and floor coverings, amounts to about 8 centimeters, so that even at a height adjustment of 7 centimeters, covering and perfect sound insulation of the bottom edge is still assured. The gaps between the floor construction and the bottom edge of the element are filled up exclusively with concrete mortar, as conventional in prefabricated building construction, with the static preconditions for stressed interior walls provided in this case, as well. The use of these wall elements is also possible to allow for later dismantling, in which case no concrete is filled in and the walls can have no static function.

It is understood that the various connections for the adjustment of individual frame parts as shown are only examples for possible embodiments of the invention. On principle, any given suitable connection for the frame parts can be used.

It is also possible to provide the wall elements, as known per se, with openings for doors, windows, hatches or the like.

Although the wall element according to the invention is intended mainly for the interior walling of buildings, it could also be used for exterior walls, for instance in prefabricated building construction.

I claim:

1. A prefabricated wall element for interior walls of buildings having subfloors over which finish floors are installed, comprising, a finish floor, a frame structure consisting of mutually adjustable parts on each side of which a cover plate having sufficient inherent thickness is attached, at least that portion of said frame structure intended to be adjacent the subfloor being arranged backwardly in relation to the edges of said cover plates so that free edges of said cover plates project beyond said portion of said frame structure on both sides, and a height adjustment for adaptation of said wall element to various room heights, said height adjustment comprising at least one adjusting screw guided with clearance in a bore piercing said portion of said frame structure between said free edges of said cover plates and supported by a screw head on said subfloor on which said wall element is to be erected, and a nut associated with said screw and non-rotatably supported on said frame structure between said free edges of said cover plates, said screw having a collar accessible for adjustment of the screw by a wrench, the arrangement being such that said free edges of said cover plates extend below the level of a finish floor after installation thereof, thereby eliminating the need for cover strips along the lower edge of said wall element.

2. The wall element claimed in claim 1, including at least one leveling piece inserted beneath said frame structure in a space between said projecting free edges, said leveling piece being provided with at least one passage bore for said adjusting screw, said associated nut being non-rotatably attached onto one of the frame structure and leveling piece.

3. The wall element claimed in claim 2, wherein said nut is plate-shaped and is provided with prong-like projections or clamps for insertion into one of the frame structure and the leveling piece, said projections or clamps being provided in corner zones of the plate.

* * * * *